United States Patent [19]

Chlad

[11] Patent Number: 4,473,809

[45] Date of Patent: Sep. 25, 1984

[54] LIFTING ELECTROMAGNET

[76] Inventor: Kenneth J. Chlad, 201 Hawthorne Dr., Chagrin Falls, Ohio 44022

[21] Appl. No.: 516,036

[22] Filed: Jul. 22, 1983

[51] Int. Cl.[3] ..... H01F 7/20

[52] U.S. Cl. ..... 335/291; 335/294

[58] Field of Search ..... 335/289, 290, 291, 292, 335/294; 294/65.5

[56] References Cited

U.S. PATENT DOCUMENTS

| | | | |
|---|---|---|---|
| 1,094,106 | 4/1914 | White | 335/294 |
| 2,184,199 | 12/1939 | Stephan | 335/294 |
| 3,372,357 | 3/1968 | Dietzel et al. . | |
| 4,103,266 | 7/1978 | Schwartz . | |

FOREIGN PATENT DOCUMENTS

| | | | |
|---|---|---|---|
| 639466 | 11/1936 | Fed. Rep. of Germany | 335/291 |
| 844655 | 9/1952 | Fed. Rep. of Germany | 335/291 |
| 726832 | 12/1966 | Italy | 335/291 |
| 814839 | 3/1981 | U.S.S.R. | 335/291 |

*Primary Examiner*—George Harris
*Attorney, Agent, or Firm*—Fay & Sharpe

[57] ABSTRACT

An electromagnet having a 360° flux pattern for attracting magnetizable items over the entire surface area of the magnet is disclosed. The electromagnet includes an outer casing having a circumferential portion constructed of non-magnetizable material, a core portion of magnetizable material, and a means for generating magnetic flux lines contained within the casing. The core is disposed generally radially within the coil and includes an inner core portion and a first magnetic pole portion extending axially from the coil. The first magnetic pole comprises a bottom wall depending from the inner core and being radially coextensive with at least a portion of the coil. The core also includes a second magnetic pole portion extending axially from the coil opposite of the first magnetic pole portion and comprising a top wall depending from the inner core which is radially coextensive with at least a portion of the coil. The core portion directs the flux lines transverse of the circumferential portion for attracting magnetic material to the surface area of the magnet. The circumferential portion comprises a side wall interposed between the top wall and the bottom wall to define a generally smooth outer surface side wall area for the magnet.

13 Claims, 4 Drawing Figures

LIFTING ELECTROMAGNET

BACKGROUND OF THE INVENTION

This invention pertains to the art of electromagnetic devices and more particularly to electromagnetic devices useful for lifting a variety of magnetizable items such as iron or steel scrap and loose ferro-magnetic material. However, it will be appreciated by those skilled in the art that the invention could be readily adapted for use in other environments as, for example, where similar lifting devices are employed to lift or transport other types of materials.

A wide variety of electromagnetic lifting devices are known in the art. The lifting power of such devices depend upon the density of magnetic flux normal to the plane of engagement between the material to be lifted and the magnet. In addition, the lifting power varied directly as a square of the normal flux density. Therefore, most lifting electromagnets are designed to employ a conformation for securing a relatively high density and definitely directed flux pattern to achieve more economical operation. All electromagnets employ an electrical coil generating a toroidally directed flux pattern about the coil. As the flux pattern is more dense radially within the coil, as opposed to the density of the flux pattern radially outset from the coil, most conventional electromagnets include a specific lifting surface substantially within the diametrical area of the coil. See U.S. Pat. No. 794,086 to Eastwood. Such a lifting surface possesses generally normally directed flux lines.

The flux lines are initially communicated through a magnetic core positioned radially within the coil and, from the core, are further communicated along the outer periphery of the magnet through outer jackets of magnetic material. The communication of the flux lines through the jackets prevents magnetic attachment to the outer sides of the magnet as opposed to the lifting surface. The jackets are spaced and magnetically insulated from the lifting surface to cause the flux lines to radiate from the jackets through the ambient air to attract a lifted item towards the lifting surface. The lines then pass through the lifting surface and ultimately back to the core which is typically in magnetic engagement to the lifting surface.

Such conventional types of lifting electromagnets have suffered from a variety of defects which inhibit advantageous operation in a number of lifting applications. For example, the provision of a single specific lifting surface as opposed to a lifting surface disposed over the entire surface area of the electromagnet, limits the amount of material that can be lifted, particularly where the lifting material is a loose fill material such as pellets or the like. In addition, it is oftentimes difficult to position the lifting surface squarely against the item to be lifted in order to take advantage of the narrowly directed flux lines emanating from the lifting surface. Such a problem obviously complicates operation in environments such as a scrap yard where a wide variety of shapes and dimensions occur on the items to be lifted, or where the items are entangled or covered.

Another problem with electromagnets utilizing a lifting surface in magnetic communication with a core within the electrical coil is the frequency of mechanical damage to the core and lifting surface plate with repeated shock and harsh engaging action to the specific lifting surface of the magnet. Where such mechanical damage occurs to the core or lifting surface, moisture frequently has access to the electrical coil which damages the coil and adversely effects the operation of the magnet.

The present invention contemplates a new and improved electromagnetic lifting device which overcomes all the above referred to problems and others to provide a new lifting electromagnet which is simple in design, economical to manufacture, readily adaptable to a plurality of lifting uses with magnetic items having a variety of dimensional characteristics, provides a 360° magnetic flux pattern for attracting items over the entire surface area of the device, and provides improved insulation and protection of the coil from operational hazards.

BRIEF SUMMARY OF THE INVENTION

In accordance with the present invention, there is provided an electromagnetic lifting device for lifting magnetic material. Generally, the device comprises an outer casing having a circumferential portion constructed of non-magnetizable material, a core portion of magnetizable material, and a means for generating magnetic flux lines contained within the casing. The core is disposed generally radially within the coil and includes an inner core portion and a first magnetic pole portion extending axially from the coil. The first magnetic pole portion comprises a bottom wall depending from the inner core and radially coextensive with at least a portion of the coil. The core also includes a second magnetic pole portion extending axially from the coil opposite of the first magnetic pole portion and comprising a top wall depending from the inner core which is radially coextensive with at least a portion of the coil. The core portion directs the flux lines transverse of the circumferential portion for attracting magnetic material to the surface area of the lifting device.

In accordance with another aspect of the present invention, the circumferential portion comprises a side wall interposed between the top wall and the bottom wall to define a generally smooth outer surface side wall area of the magnet.

In accordance with a further aspect of the present invention, the bottom wall includes a planar portion conformed for lifting items having a planar surface.

In accordance with yet another aspect of the present invention, magnetic flux lines are directed from the top wall, transverse of the side wall, and received within the bottom wall and the bottom wall planar surface to define a 360° flux pattern for attracting magnetic items over the entire surface area of the lifting device.

One benefit obtained by use of the present invention is an electromagnetic lifting device which has a surface conformation and attracting flux pattern which facilitates lifting of a wide variety of magnetic items regardless of identity, shape or entanglement of the items to be lifted.

Another benefit obtained from the present invention is a lifting device which provides a surface lifting area which is relatively greater than the lifting surface areas of conventional electromagnets.

A further benefit of the present invention is an electromagnetic lifting device having a structural conformation which provides improved protection to the magnetic core and electrical coil.

Other benefits and advantages for the subject new electromagnetic lifting device will become apparent to those skilled in the art upon a reading and understanding of this specification.

BRIEF DESCRIPTION OF THE DRAWINGS

The invention may take physical form in certain parts and arrangements of parts, the preferred embodiment of which will be described in detail in the specification and illustrated in the accompanying drawings which form a part hereof and wherein.

DETAILED DESCRIPTION OF THE INVENTION

Figure 2:
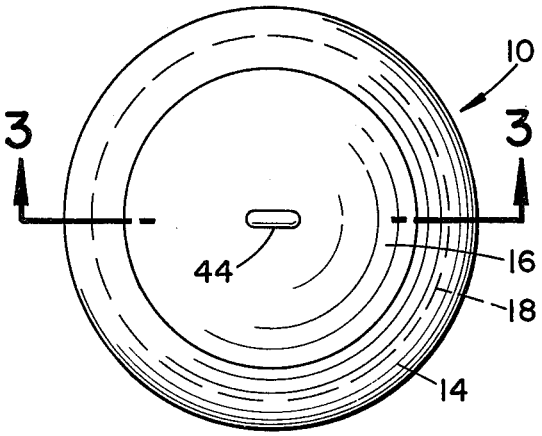
FIG. 2 is a plan view of the device in the direction of line 2—2 of FIG. 1.

Referring now to the drawings wherein the showings are for purposes of illustrating the preferred embodiment of the invention only and not for purposes of limiting the same, the FIGURES show an electromagnetic lifting device 10 comprising a bipolar magnet for handling or transporting magnetic material.

Figure 1:
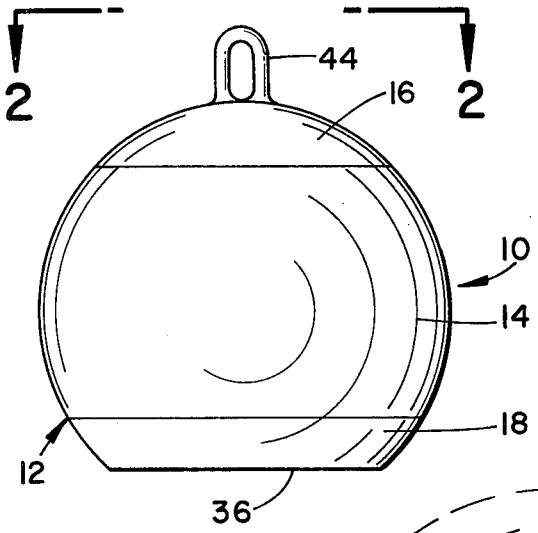
FIG. 1 is a side elevational view of an electromagnetic lifting device formed in accordance with the present invention.

With specific reference to FIG. 1, the device 10 is illustrated as preferably having a generally spherical conformation. However, a multifaceted surface conformation, such as a plurality of hexagonally configured walls could also be advantageously employed. The device has an outer casing 12 having a circumferential portion 14 constructed of non-magnetizable material, such as non-magnetic steel. A top wall portion 16 and bottom wall portion 18 mateably abut the circumferential portion 14 to define a generally smooth outer surface area of the device 10.

Figure 3:
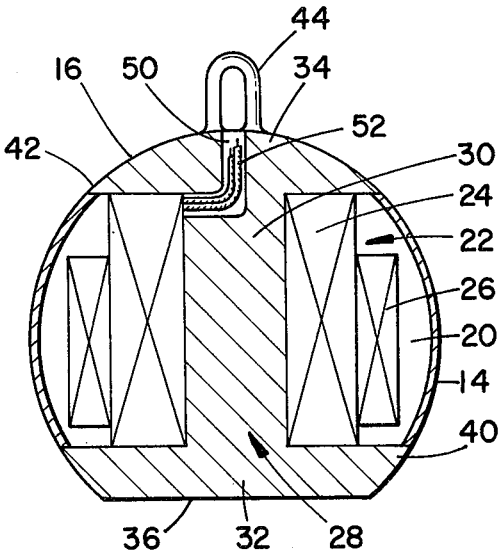
FIG. 3 is a cross-sectional view taken along line 3—3 of FIG. 2.

With particular reference to FIGS. 1, 2 and 3, the casing 12 contains a means for generating magnetic flux lines comprising an electrical coil generally designated 22. In the preferred embodiment, coil 22 includes a first electrical wire coil 24 generally axially coextensive with circumferential portion 14, and a second electrical wire coil 26 radially outset from the first coil and having a lesser axial extent than the first coil. The coils 24, 26 are contained in a coil chamber 20.

A magnetic core generally designated 28 formed of magnetizable material such as ferro-magnetic steel or the like is disposed within the electrical coil 22 for communicating magnetic flux lines within the coil. The core 28 includes an inner core portion 30, a first magnetic pole portion 32, and a second magnetic pole portion 34. The first magnetic pole portion comprises a bottom wall portion integrally depending from the inner core and being radially coextensive with at least a portion of the electrical coil 22. The second magnetic pole portion 34 comprises a top wall portion integrally depending from the inner core portion and being radially coextensive with at least a portion of the coil 22. The coil chamber 20 is thus defined by the inner core portion 30, the radially outset portion of the first magnetic pole portion 32, the radially outset portion of the second magnetic pole portion 34 and the circumferential side wall 14.

The surface of the first magnetic pole portion 32 comprises bottom wall 18 and includes a generally planar bottom wall lifting surface 36 axially spaced from the coil 22. Surface 36 is specifically conformed for lifting items also having a planar surface. The radially outermost terminal area 40 of the bottom wall 18 and the radially outermost terminal area 42 of the top wall 16 abut the circumferential side wall 14 so as to define a generally smooth outer surface for the device 10 at the bottom and top wall terminal ends. Such smooth surface prevents particular shocks to the edge portions of the circumferential side wall 14 that may damage the sealing abutment of the side wall 14 to the bottom wall 32 and top wall 34 which might otherwise allow moisture exposure to the coil 22.

The top wall 16 includes an attachment handle 44 protruding outwardly therefrom which, in turn, is typically attached to a conventional cable or the like (not shown) for handling of the device 10. An electrical lead passageway 50 is also included in the second magnetic pole portion 34 to accommodate the electrical leads 52 required for the coil 22. Passageway 50 is conventionally sealed to protect the coil against moisture and other contaminants which could otherwise access the coil through the passageway.

Figure 4:
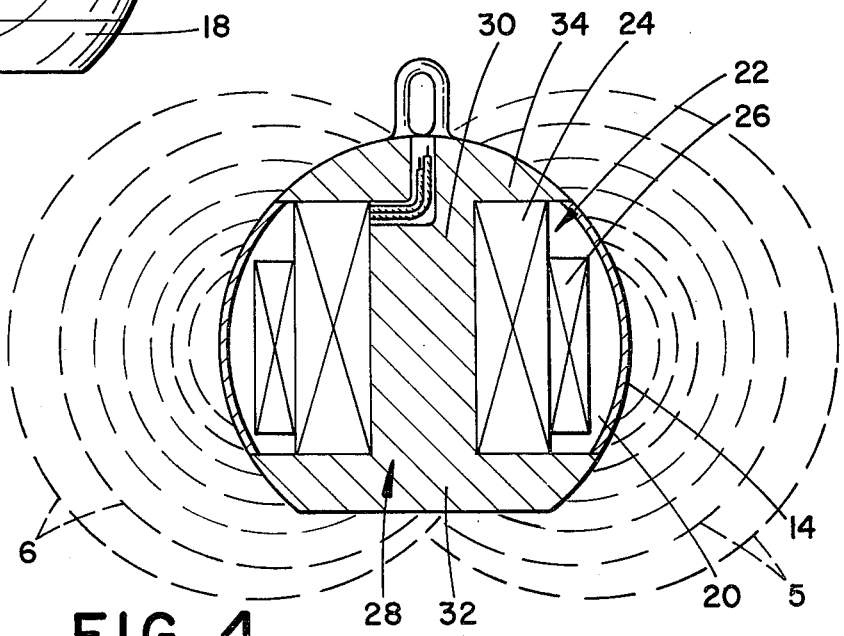
FIG. 4 is the cross-sectional view of FIG. 3 particularly showing the magnetic flux line pattern generated by the device in operation.

With particular reference to FIG. 4, the improved operational characteristics of the new electromagnetc lifting device will be specifically discussed.

In the preferred embodiment, the means for generating electric flux lines comprises the first coil 24 contiguous to the inner core portion 30 and the second coil 22 radially outset from the first coil. Upon energization of the coils, a plurality of magnetic flux lines 56 are generated which are directed toroidally about the coils. Flux lines may be communicated through a magnetic material but not through a non-magnetic material or air. Accordingly, flux lines may pass through the core 30 but not through the side wall 14 or the coil chamber 20. The flux lines are directed transversely of the side wall 14, and when passing through a separate magnetic item such as a ferrous material, the item is attracted by the flux lines against the surface through which the flux lines are generated. The magnetic field is thus set up between the first pole portion 32 and the second pole portion 34 which allows attraction of ferrous material to the entire surface area of the device 10 by the 360° flux flow pattern of the flux lines.

The potential lifting capacity of a magnet on scrap or any loose magnetic material is based on the strength of the coil (ampere turns), the amount of steel in the magnetic circuit, and the amount of contact the lifting surface has with the material. The subject invention allows a 360° flux path and, therefore, increases the effective contact area and the lifting capacity over prior conventional magnets at equal weight.

The invention has been described with reference to the preferred embodiment. Obviously, modifications and alterations will occur to others upon the reading and understanding of the specification. It is my intention to include all such modifications and alterations insofar as they come within the scope of the appended claims or the equivalents thereof.

Having thus described my invention, I now claim:

1. A bi-polar magnet for handling of magnetic material comprising:

a generally spherically configured outer casing housing an electrical coil and a magnetizable core, said casing including a non-magnetizable side wall portion for communicating a 360° magnetic flux pattern upon energization of said electrical coil, said flux pattern being disposed transverse said side wall for attracting magnetic material to the surface area of said magnet, said coil being disposed in a surrounding relationship with an inner core portion, said core including a first magnetic pole portion extending axially from said coil to comprise a bottom wall depending from said inner core portion and being radially coextensive with at least a portion of said coil, said first magnetic pole portion further including a radially outermost terminal area portion abutting said side wall portion to define a generally smooth outer surface for the magnet whereby magnetic items may be attracted to said bottom wall and said radially outermost terminal area portion to provide a lifting area at the bottom wall and the side wall.

2. The magnet as defined in claim 1 wherein said core further includes a second magnetic pole portion extending axially from said coil opposite of said first magnetic pole portion to comprise a top wall depending from said inner core portion and being radially coextensive with at least a portion of said coil.

3. The magnet as defined in claim 2 wherein said side wall portion abuts a terminal end of said bottom wall and a terminal end of said top wall.

4. The magnet as defined in claim 3 wherein said side wall portion has a surface adjacent to said top wall and said bottom wall to define a generally smooth outer surface of said magnet at said top wall terminal end and said bottom wall terminal end.

5. An electromagnetic lifting device for lifting magnetic material comprisin:

an outer casing having a circumferential portion constructed of non-magnetizable material, said casing further having means for generating magnetic flux lines transverse said circumferential portion, and a core portion of magnetizable material for communicating said flux lines within said means for generating said core portion including a radially outermost terminal area portion abutting said circumferential portion, said radially outermost terminal area portion and said circumferential portion comprising a side wall area of said lifting device whereby said lifting device may selectively magentically lift the magnetic material upon association of said device with said material and energization of said means for generating magnetic flux lines.

6. The device as disclosed in claim 5 wherein said outer casing is generally spherical in conformation.

7. The device as disclosed in claim 6 wherein said casing includes a planar bottom wall.

8. The device as disclosed in claim 7 wherein said planar bottom wall defines a first magnetic pole portion axially spaced from said means for generating magnetic flux lines.

9. The device as disclosed in claim 8 wherein said planar bottom wall is integral with said core portion and a second magnetic pole portion spaced opposite from said first magnetic pole, said second magnetic pole being axially spaced from said means for generating magnetic flux lines.

10. The device as disclosed in claim 9 wherein said second magnetic pole portion includes means for accessing said means for generating magnetic flux lines with electrical power leads.

11. The device as disclosed in claim 5 wherein said means for generating magnetic flux lines comprises a first electrical wire coil contiguous to said core portion and a second electrical wire coil radially outset from said first coil.

12. The device as disclosed in claim 11 wherein said second coil has an axial dimension less than said first coil.

13. The device as disclosed in claim 5 wherein said non-magnetizable circumferential portion is generally axially coextensive with said means for generating magnetic flux lines.

* * * * *